United States Patent [19]

Chang

[11] Patent Number: 4,989,015

[45] Date of Patent: Jan. 29, 1991

[54] UNFURLABLE MESH REFLECTOR

[75] Inventor: Stanley S. Chang, Palos Verdes Estates, Calif.

[73] Assignee: Hughes Aircraft Company, Los Angeles, Calif.

[21] Appl. No.: 112,592

[22] Filed: Oct. 26, 1987

[51] Int. Cl.[5] ..... H01Q 15/20

[52] U.S. Cl. ..... 343/915; 343/881

[58] Field of Search ..... 343/912, 915, 840, 880, 343/881, DIG. 2

[56] References Cited

U.S. PATENT DOCUMENTS

| | | | |
|---|---|---|---|
| 3,496,687 | 2/1970 | Greenberg et al. | 343/915 |
| 3,509,576 | 4/1970 | McLain | 343/840 |
| 3,576,566 | 4/1971 | Cover et al. | 343/915 |
| 3,631,505 | 12/1971 | Carman et al. | 343/915 |
| 3,635,547 | 1/1972 | Rushing et al. | 343/915 |
| 3,717,879 | 2/1973 | Ganssle | 343/915 |
| 4,498,087 | 2/1985 | Imbiel et al. | 343/915 |
| 4,642,652 | 2/1987 | Herbig et al. | 343/915 |

*Primary Examiner*—Rolf Hille
*Assistant Examiner*—Michael C. Wimer
*Attorney, Agent, or Firm*—Steven M. Mitchell; Robert A. Westerlund; Wanda Denson-Low

[57] ABSTRACT

An unfurlable antenna reflector comprises a rigid central truss (12) on which are pivotally mounted circumferentially spaced booms (18). A network of tensioning cables (24) interconnect the ends of the booms to define a reflector-supporting net when the booms are in their fully deployed position. The booms deploy sequentially, to minimize shock loading, and have lengthening means (22) which simultaneously extend the outer ends of the booms after all the booms have reached their deployed position. A flexible mesh-like reflector surface (20) is connected to the net and is formed into a predetermined non-planar shape by net-shaping secondary cables (30).

9 Claims, 3 Drawing Sheets

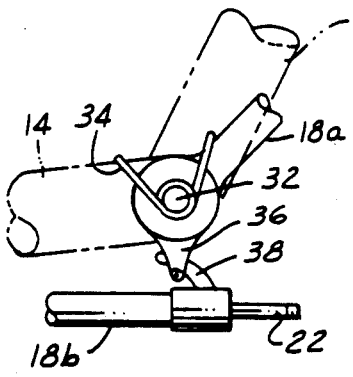
FIG.4
FIG.5A
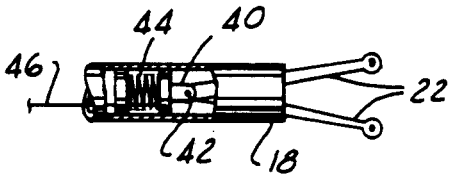
FIG.5B
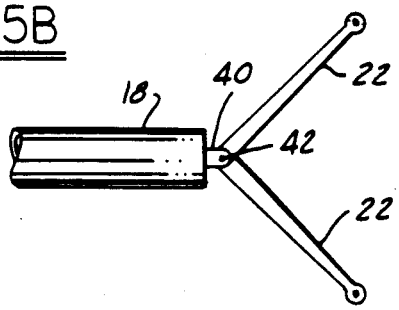

FIG. 3A
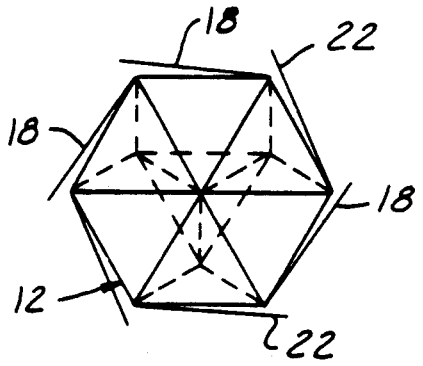
FIG. 3B
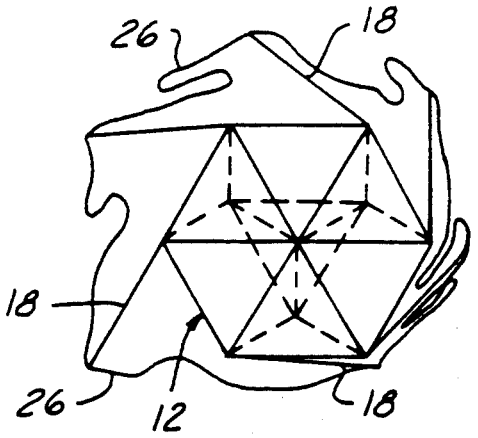
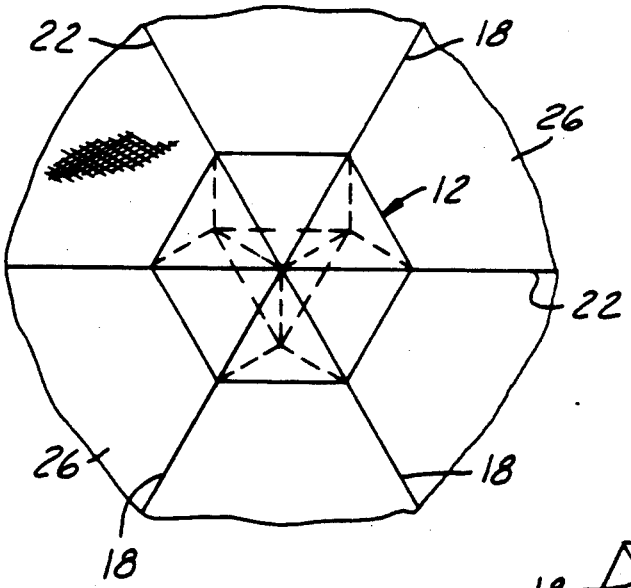
FIG. 3C
FIG. 3D
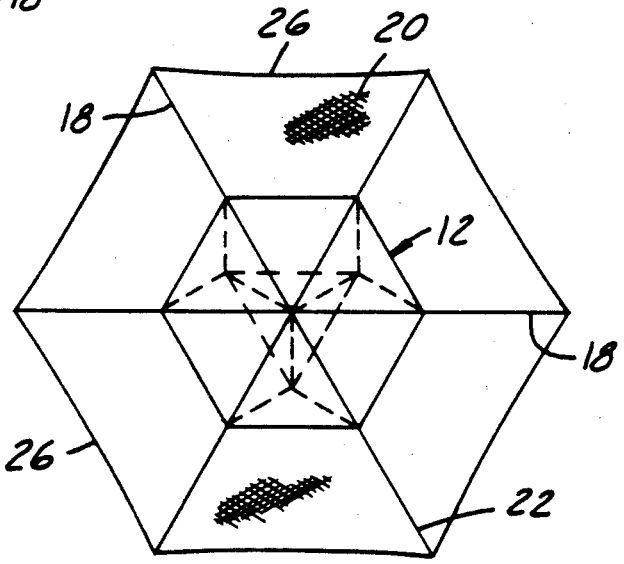

UNFURLABLE MESH REFLECTOR

BACKGROUND OF INVENTION

This invention relates to antenna reflectors, and more particularly to reflectors which are collapsible for storage in a minimum volume prior to deployment in the environment of space. Large antennas intended for use in space must meet several demanding design criteria. They must be lightweight and collapsible to a minimum volume for ease of transport to their ultimate deployed location. They must be strong enough to maintain their deployed shape for maximum efficiency of the reflector surface. The construction of such antennas, particularly, the mechanism by which they are deployed from their minimum volume storage condition, must be simple and reliable, because there is generally no opportunity for on-site repair or maintenance.

A variety of constructions and mechanisms have been devised to achieve these objectives. Some have employed a flexible reflective mesh material for the surface of the antenna, such mesh being supported and shaped by various systems of hinged or flexible booms, arms, or trusses, sometimes supplemented by tension cables. Examples of such prior art include U.S. Pat. Nos. 3,913,105, 4,030,102 and 4,030,103.

As the size of such reflectors increases, the complexity of the supporting structure and deployment mechanism tends to increase, with accompanying penalties in weight, cost, and reliability.

An important object of the present invention is to provide an unfurlable mesh reflector suitable for applications requiring large aperture diameter reflectors, even up to the range of forty feet in diameter. It is desirable that such reflector be capable of accommodating both low and high frequency signals and that it have a simple and reliable deployment mechanism, with minimal shock loads created by the deployment sequence.

SUMMARY OF THE INVENTION

The unfurlable antenna reflector of the present invention comprises a rigid central truss on which a plurality of deployable booms are pivotally mounted for movement between a retracted storage position and a radially-extended deployed position. The ends of the booms are interconnected, both radially and circumferentially, by tensioning cables which define a mesh reflector-supporting front net. Additional tension cables interconnect the back side of the booms to the central truss, to balance the deflecting loads on the booms. In their retracted position, the booms are arranged so that the outer end of each boom lies adjacent to the inner end of the next circumferentially adjacent boom, whereby a latch mechanism on the inner end of each boom automatically releases the outer end of the adjacent boom after the first boom has swung through a predetermined portion of its pivotal movement toward its deployed position, thereby gradually sequencing the deployment of the remaining booms. The final cable-tensioning extension of the booms is provided by a supplementary extension mechanism on the tip of each boom. These mechanisms are activated simultaneously so that final tension is applied uniformly around the entire periphery of the front net.

FIGS. *3a*, *3b*, *3c* and *3d* show the sequence of deployment of the antenna from its folded or retracted condition to its fully extended or deployed condition.

FIG. 4 is an enlarged fragmentary view of a portion of two adjacent booms in their folded position.

FIGS. *5a* and *5b* are an enlarged detail of the outer tip of a typical boom, showing the tip prongs in their folded and deployed positions, respectively.

DETAILED DESCRIPTION OF THE PREFERRED EMBODIMENT

Figure 1:
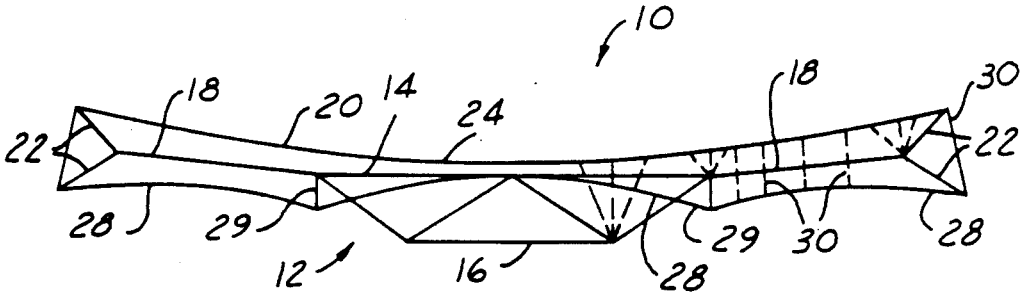
FIG. 1 is a side view of the deployable antenna of the present invention.
Figure 2:
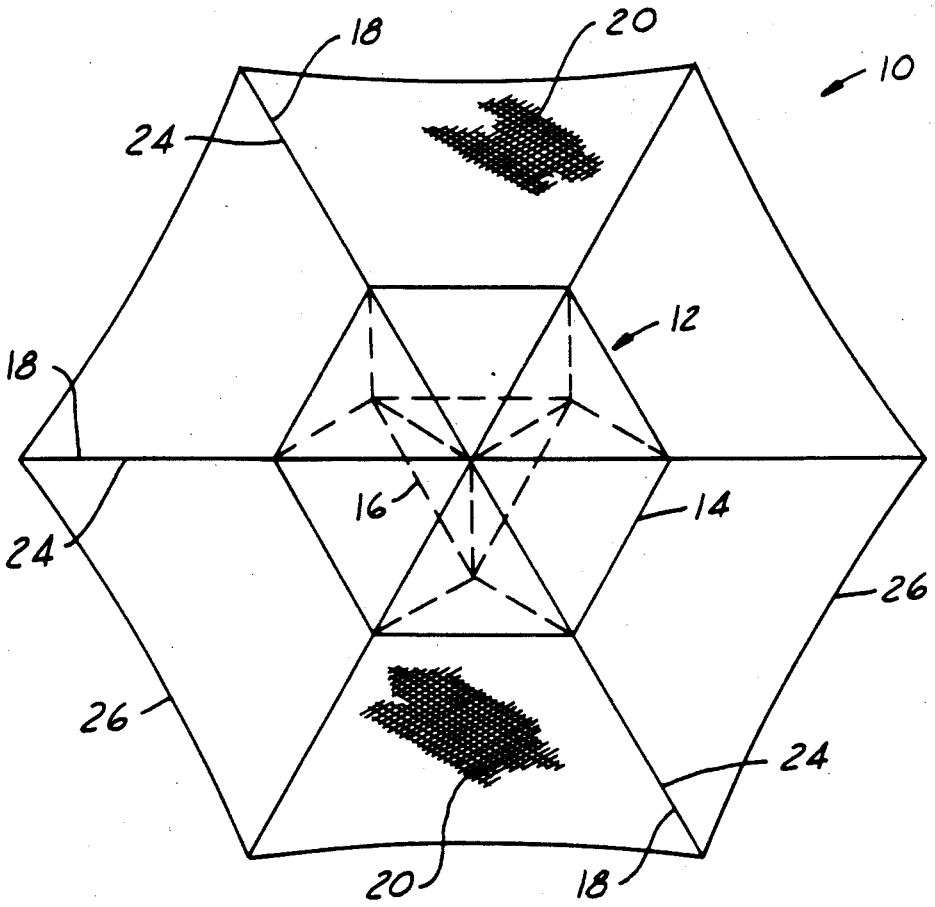
FIG. 2 is a front view of the antenna of FIG. 1.

Referring to FIGS. 1 and 2 of the drawings, reflector assembly 10 comprises a central, rigid, non-collapsible geodesic truss 12 which in turn comprises a hexagonal front frame 14 connected to a triangular rear frame 16 by a plurality of rigid strut members. At each vertex of front frame 14 there is pivotally mounted a deployable radial boom 18, shown in their radially-extended or deployed condition in FIGS. 1 and 2. The reflectively coated flexible mesh surface 20 spans the area generally defined by booms 18, being supported and shaped by a network of cables to be described below.

As best shown in FIGS. 1 and 5, the outer end of each boom has a supplementary cable-tensioning mechanism comprising a pair of boom tip prongs 22. These tip prongs provide the connection point for the network of mesh-supporting and boom-stabilizing cables.

Specifically, the boom tip prongs on the front or reflector side of truss 12 are interconnected by a series of front radially-extending cables 24 which span across the entire assembly between diametrically opposite booms 18. The front tip prongs are further interconnected by a series of front circumferential cables 26 connecting the tip prongs of adjacent booms. A similar set of circumferential cables may interconnect the tip prongs on the back or rear side of each boom. Such rear tip prongs are also connected by rear cables 28 to truss 12, in order to balance any deflecting loads caused by the tension in the front cables. As shown in FIG. 1, cables 28 pass over the ends of compression struts 29 before being anchored at their inner ends at the center of the truss. Struts 29 extend rearwardly from each vertex of front frame 14. This configuration improves the angle of the balancing forces applied by cables 28. An additional system of secondary cables 30 interconnect front and rear cables 24, 28, respectively, and may additionally interconnect front cables 24 with various points on truss 12.

As will be understood by those skilled in the art, this network of cables serves two purposes. First, it braces and stabilizes booms 18 in their extended or deployed condition, in order to establish the essential reflector position-defining basic structure of the assembly. Secondly, the cable network defines the vital curved shape of reflective mesh 20. Typically, it is desirable that the mesh be maintained in the shape of a paraboloid, although any other desired shape can be defined by appropriate shaping of the front network of radial and circumferential cables 24, 26. It is contemplated that reflective mesh 20 may be connected to the front cable network by means of tying, bonding, or other mechanical connectors.

Referring now to FIGS. 3 and 4 of the drawings, the boom-deploying mechanism will now be described. Each boom 18 is pivotally mounted on a pivot axis 32 to one of the vertices of front frame 14, as fragmentarily shown in FIG. 4. For ease of explanation, the inner end of a first typical boom is referenced by numeral 18*a*, while the outer end of the next adjacent boom is referenced as 18*b*. It is to be understood that this illustrated pair of booms is typical of the construction and interaction of each adjacent pair of booms.

A torsion spring 34 biases each boom toward its radially-extended or deployed position (i.e., clockwise as viewed in FIG. 4). The inner end or hub portion of boom 18*a* has a retaining latch 36 which normally engages finger 38 on the outer end of adjacent boom 18*b* to hold boom 18*b* in its folded position against the biasing force of spring 34. As will be seen from FIG. 4, when a first boom 18*a* is released from its folded position along the adjacent side of front frame 14 (e.g., by suitable pyrotechnic or release pin means), a predetermined degree of clockwise rotation of boom 18*a* (e.g., ten degrees) will cause its similarly pivoting retaining latch 36 to rotate out of engagement with finger 38 of adjacent boom 18*b*. Once finger 38 is released, the torsion spring for boom 18*b* will cause it to pivot to its radially-extended position. Such rotation of boom 18*b* will similarly release the next circumferentially adjacent boom. The result is that the six booms will deploy sequentially rather than simultaneously. This sequential deployment minimizes the shock and danger of damage to the reflector assembly. An overview of the deployment sequence is seen in the progression of figures comprising FIG. 3 of the drawings.

The final step of deployment of the reflector mesh 20 involves deployment of boom tip prongs 22. Preferably, to further minimize strain on flexible mesh 20, final tensioning of the mesh-supporting and positioning cables is delayed until all booms 18 have reached their fully extended position. Then each boom is simultaneously lengthened by the release of axially extendable tip prongs 22, thereby uniformly applying and distributing the cable tensioning forces around the entire assembly.

Referring to FIG. 5, the outer ends of hollow booms 18 contain a prong support rod 40 which has a pivot pin 42 on which is pivotally mounted the pair of prongs 22. Rod 40 is biased axially outwardly, toward the deployed position of FIG. 5*b*, by compression spring 44. However, rod 40 is normally maintained in its retracted position of FIG. 5*a* by tension of retaining wire 46. These wires run the full length of the hollow interior of booms 18 and are anchored at a central collection point on truss 12. When support rod 40 is in its inwardly retracted position, the prongs are radially withdrawn and substantially confined within the outer end of the boom. When the last of the six booms has reached its fully deployed position, a suitable pyrotechnic device (not shown) is activated to simultaneously sever all six retaining wires 46 at their collection point, thereby deploying all six pairs of tip prongs 22 to their position of FIG. 5*b*. That final uniformly applied extension provides the necessary shape-controlling and boom-stabilizing tension in the various cables.

To achieve the desired high strength-to-weight ratio for the structure, the truss and booms may, for example, be fabricated of an epoxy-graphite composite. The cables should possess high tensile strength and be transparent to radio frequencies. Suitable materials for the cables include continuous quartz or Kevlar. It is estimated that a forty foot diameter reflector constructed in accordance with this invention would weigh about twenty-four pounds, exclusive of mesh and cables.

This invention may be further developed within the scope of the following claims. Accordingly, the above specification is to be interpreted as illustrative of only a single operative embodiment of this invention, rather than in a strictly limited sense.

I now claim:

1. An unfurlable antenna reflector comprising:

a rigid central truss having front and rear sides;

a plurality of deployable booms each having an inner end and an outer end with said inner ends being connected to said truss at pivot points circumferentially spaced around said truss for pivoting movement of said booms between a retracted position, wherein said booms are substantially coplanar, and a deployed position, wherein they extend radially away from said central truss in a generally spoke-like array, the outer ends of said booms defining an imaginary plane which is spaced forwardly from said truss, and wherein further, each of said boom pivot points has a pivot axis oriented such that said boom pivot axes are substantially parallel, said booms being positioned and dimensioned so that, in their retracted position the outer end of each boom lies adjacent the inner end of the next circumferentially adjacent boom;

a front net comprising cables interconnecting said boom outer ends, said front net being tensioned when said booms are in their deployed position and spanning the area between said booms said front net being spaced forwardly from said booms and said truss so that said truss lies totally behind said front net;

reinforcing tension means interconnecting said booms and said truss and being located on the rear side of said booms to minimize deflection of said booms by said front net;

a flexible radio frequency-reflecting mesh-like reflector surface connected to and substantially coextensive with said front net and deployed forwardly of said front side of said truss when said booms are in their deployed position, said reflector surface being contoured into a predetermined non-planar shape by its connections to said front net.

2. The antenna reflector of claim 1 wherein said booms are resiliently biased toward their deployed positions, the inner end of each boom having a retaining means which normally engages the outer end of the next circumferentially adjacent boom to retain said adjacent boom in its retracted position, but a predetermined movement of each boom from its retracted position toward its deployed position causing said retaining means to disengage from the next circumferentially adjacent boom to permit said next boom to be resiliently deployed to its radially extended position.

3. The antenna reflector of claim 1 wherein said front net comprises (1) circumferential cables acting in tension between each deployed boom and its circumferentially adjacent booms, and (2) radial cables acting in tension between the outer portion of each deployed boom and the outer portion of its diametrically opposite deployed boom.

4. The antenna reflector of claim 1 wherein said reinforcing tension means comprises rear cables.

5. The antenna reflector of claim 1 wherein said booms are resiliently biased toward their deployed positions, retaining means being mounted on said truss for normally maintaining said booms in their retracted positions, and sequentially operable means for causing said retaining means to release said booms from their retracted positions in a manner such that said booms reach their fully deployed positions at phased time intervals.

6. The antenna reflector of claim 5 wherein each of said booms is provided with extension means which simultaneously deploy axially outwardly to increase the effective length of the booms only after all of the booms have reached their fully deployed positions, said front net cables being connected to said boom ends at the outer end of said extension means.

7. The antenna reflector of claim 1 wherein each of said booms is provided with extension means which simultaneously deploy axially outwardly to increase the effective length of the booms only after all of the booms have reached their fully deployed positions, said front net cables being connected to said booms at the outer end of said extension means.

8. The antenna reflector of claim 7 wherein said extension means each comprise a pair of prongs which diverge forwardly and rearwardly from the outer end of their associated boom when in their deployed position, said front net cables being secured to the outer end of said forwardly diverging prongs and said reinforcing tension means being in the form of rear cables which are secured to the outer end of said rearwardly diverging prongs.

9. In an unfurlable antenna reflector assembly which utilizes a flexible radio frequency-reflecting mesh-like reflector surface, the improved method of supporting said reflector surface and deploying such assembly from a retracted storage position to an extended deployed position, comprising:

pivotally mounting a series of rigid booms at circumferentially spaced points about a rigid central truss, said booms being arranged and mounted so that they are substantially coplanar when in their retracted positions and extend radially away from said central truss when in their deployed positions;

sequencing the deployment of said booms so that after a first boom moves through a predetermined portion of its deployment path, the next circumferentially adjacent boom starts to deploy, whereby said booms reach their fully deployed positions sequentially and at phased time intervals;

lengthening the outer end of said booms simultaneously but only after all of said booms have reached their deployed positions;

interconnecting the ends of said booms by flexible cables which are tensioned by said boom-lengthening step, said cables being arranged so that, when tensioned, they establish a net-like array which spans the area defined by said deployed booms;

shaping said net-like array into a predetermined non-planar surface; and, connecting the reflector surface to said net-like array so that said reflector surface assumes the shape of said tensioned net-like array.

* * * * *